US007368679B2

(12) United States Patent
Buxton et al.

(10) Patent No.: US 7,368,679 B2
(45) Date of Patent: May 6, 2008

(54) ARRANGEMENT COMPRISING A LOW VOLTAGE POWER SWITCH AND A SWITCHING GAS DAMPER PROVIDED WITH A CARRIER ELEMENT AND USED FOR THE LOW VOLTAGE POWER SWITCH

(75) Inventors: Clifford A. Buxton, Bellefontaine, OH (US); Thomas Leye, Berlin (DE); Stefan Losch, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/529,499

(22) PCT Filed: Aug. 28, 2003

(86) PCT No.: PCT/DE03/02882

§ 371 (c)(1),
(2), (4) Date: Jan. 17, 2006

(87) PCT Pub. No.: WO2004/032167

PCT Pub. Date: Apr. 15, 2004

(65) Prior Publication Data

US 2006/0138089 A1 Jun. 29, 2006

(30) Foreign Application Priority Data

Sep. 30, 2002 (DE) ..... 202 15 343

(51) Int. Cl.
*H01H 33/12* (2006.01)

(52) U.S. Cl. ..... 218/157; 218/152

(58) Field of Classification Search ..... 218/2, 218/7–9, 14, 15, 34, 46, 76, 78, 81–85, 149, 218/153, 152, 156–158; 335/8–10; 361/212, 361/213, 604, 612, 618, 619
See application file for complete search history.

(56) References Cited

U.S. PATENT DOCUMENTS

| | | | | |
|---|---|---|---|---|
| 4,876,424 | A * | 10/1989 | Leone et al. | 200/306 |
| 4,884,047 | A * | 11/1989 | Baginski et al. | 335/10 |
| 6,100,778 | A | 8/2000 | Deylitz | |
| 6,248,971 | B1 | 6/2001 | Morel et al. | |
| 6,762,389 | B1 * | 7/2004 | Crooks et al. | 218/157 |
| 6,844,514 | B2 | 1/2005 | Bach et al. | |
| 2003/0168433 | A1 | 9/2003 | Kurzmann | |

FOREIGN PATENT DOCUMENTS

DE 1 954 066 4/1971

(Continued)

OTHER PUBLICATIONS

Catalogue 2004; "LV power circuit breakers and switch-disconnectors Masterpact NT and NW" Merlin Gerin.

(Continued)

*Primary Examiner*—Elvin Enad
*Assistant Examiner*—M. Fishman
(74) *Attorney, Agent, or Firm*—Harness, Dickey & Pierce, P.L.C.

(57) ABSTRACT

A switching gas damper is for low voltage power switches, especially for low voltage power switches which can be inserted into low voltage switching installations. The switching gas damper is arranged above an arc extinguisher of the low voltage power switches and includes at least one inlet for switching gases and at least one outlet for damped deionised switching gases. The switching gas damper is provided with a carrier element which can be arranged directly adjacent to the arc extinguisher and can be fixed to a housing receiving the low voltage power switch. The carrier element forms at least one receiving chamber for a flow element creating a flow resistance for the switching gases, and the at least one receiving chamber can be closed by at least one closing element fixing the at least one flow element. The carrier element forms the at least one inlet and the at least one closing element forms the at least one outlet.

19 Claims, 2 Drawing Sheets

FOREIGN PATENT DOCUMENTS

| | | | |
|---|---|---|---|
| DE | 2 165 942 | | 7/1973 |
| DE | 35 41 514 | A1 | 5/1987 |
| DE | 196 38 948 | A1 | 3/1998 |
| DE | 298 07 119 | U1 | 6/1998 |
| DE | 199 20 042 | C1 | 11/2000 |
| DE | 100 33 936 | A1 | 1/2002 |
| DE | 100 36 370 | A1 | 1/2002 |
| EP | 0 437 151 | A1 | 7/1991 |

OTHER PUBLICATIONS

Siemens; Low Voltage Circuit Breaker; WL Circuit Breaker; Catalog No. WLULOPMAN1.

* cited by examiner

ARRANGEMENT COMPRISING A LOW VOLTAGE POWER SWITCH AND A SWITCHING GAS DAMPER PROVIDED WITH A CARRIER ELEMENT AND USED FOR THE LOW VOLTAGE POWER SWITCH

This application is the national phase under 35 U.S.C. § 371 of PCT International Application No. PCT/DE2003/002882 which has an International filing date of Aug. 28, 2003, which designated the United States of America and which claims priority on German Patent Application number DE 202 15 343.6 filed Sep. 30, 2002, the entire contents of which are hereby incorporated herein by reference.

FIELD OF THE INVENTION

The invention generally relates to the field of electrical switches and can be used when designing a switching gas damper for low-voltage power circuit breakers (switches), in particular for low-voltage power circuit breakers which can be inserted in low-voltage switchgear assemblies.

BACKGROUND OF THE INVENTION

Air-break low-voltage power circuit breakers require for operation an arc-quenching device in order to cause switching arcs which occur to be quenched without impairing the power circuit breaker itself and adjacent parts of the assembly or other modules. On the other hand, there is the risk of the hot and thus ionized arc gases causing electrical flashovers, injuring operating personnel or causing other damage.

It is known, on the one hand, to provide arcquenching chambers which accommodate the arc to be quenched and are designed for the temperature and pressure of the switching gases occurring. In order in particular applications of low-voltage power circuit breakers, for example when they are installed in tightly restricted areas, to achieve further cooling and final ionization of the switching gases, it is known, in addition to the arc-quenching chamber, to provide a switching gas damper which is arranged in the flow path of the switching gases, downstream of the quenching chamber.

DE 35 41 514 C2 proposes, for this purpose, arranging an attachment on the arc-quenching chamber which accommodates a number of perforated inserts, these inserts being, for example, sheets provided with closely adjacent perforations or sections of a wire fabric.

A similar switching gas damper is known from U.S. Pat. No. 6,248,971 B1, in accordance with which perforated plates are likewise provided.

A further switching gas damper is known from DE 298 07 119 U1. However, instead of the plates or instead of a wire fabric, in this case parallel webs are provided which are arranged such that they are offset.

DE 19 54 066 A has disclosed an arrangement having a low-voltage power circuit breaker and a switching gas damper, which is provided with a bearing element, for the low-voltage power circuit breaker. Here, the switching gas damper is arranged above an open arc-quenching chamber of the low-voltage power circuit breaker and has at least one inlet opening for switching gases and at least one outlet opening for damped or completely ionized switching gases. Further, the bearing element can be fixed on a housing accommodating the low-voltage power circuit breaker above the arc-quenching chamber and forms at least one accommodating area for a flow element which builds up a flow resistance for the switching gases, the bearing element forming the at least one inlet opening. However, the solution is very space-intensive.

A less space-intensive solution is given by EP 0 437 151 A1. In this case, the switching gas damper is arranged on a switchgear cell, which accommodates the power circuit breaker, immediately adjacent to the arc-quenching chamber. The switching gas damper includes an integral housing having openings on its upper side. The housing interior is divided into two regions by means of a perforated plate. Such a design is unfavorable in terms of manufacturing. In addition, the housing interior is only accessible once the entire switching gas damper has been removed from the switchgear assembly.

SUMMARY OF THE INVENTION

An embodiment of the invention includes an object of providing a switching gas damper of the generic type which is characterized by a simple and compact design and which does not increase the blowout space provided (expansion space above the arc chamber).

An object may be achieved according to an embodiment of the invention by a switching gas damper. The fact that the at least one accommodating area can be closed by at least one closure element which fixes the at least one flow element, and the fact that the at least one closure element forms the at least one outlet opening advantageously means that the flow element can be fitted on the switching gas damper in a simple manner and precautions can be taken for safe damping and complete ionization of the switching gases in a very narrow space.

The bearing element of the switching gas damper and thus the switching gas damper as a whole is preferably fixed on a guide frame for the power circuit breaker. Thus, the switching gas damper is formed and can be arranged independently of the low-voltage power circuit breaker and independently of the shape of the internal area of a switchgear cell above the guide frame. To this extent, the physical shape and physical size can be adapted in a simple manner to different guide frames or to different low-voltage power circuit breakers, and possibly to different quenching chambers of low-voltage power circuit breakers. However, it is not necessary to adapt the switchgear cells of switchgear cabinets or switchgear assemblies. The switching gas damper according to an embodiment of the invention is ,thus characterized by having a high degree of flexibility as regards its design and its arrangement.

One preferred refinement of an embodiment of the invention provides for the accommodating area for the flow element to be formed by a trough-like depression in the bearing element. As such, the height of the bearing element (physical height) can also at the same time be utilized for the arrangement of the flow element, with the result that the switching gas damper as a whole is characterized by a very flat design. Furthermore, the trough-like depression at the same time serves the purpose of positioning the at least one flow element in a positionally accurate manner, with the result that operation is prevented from being impaired by the flow elements being displaced or being positioned incorrectly.

In particular, it is further preferred if a base of the trough-like depression, whilst forming an at least partially peripheral retaining web, at the same time forms the inlet opening for the switching gases into the switching gas damper. This ensures that there is a good flow onto the at least one flow element and, at the same time, its positioning in the accommodating area (trough-like depression) is not impaired.

One further preferred refinement of an embodiment of the invention provides for the at least one flow element to be formed by steel wire nets which are preferably arranged in layers. This makes it possible to achieve a flow element which corresponds to the requirements using the smallest possible amount of space by way of the steel wire nets. The result is that, despite the small physical area taken up by the switching gas damper as a whole, effective damping and complete ionization of the switching gases is ensured.

One preferred refinement of an embodiment of the invention also provides for the bearing element to form a number, which corresponds to the number of switching poles of the low-voltage power circuit breaker, of accommodating areas for flow elements. This makes it possible to assign a dedicated switching gas damper to each switching pole, it being possible for said switching gas dampers to be integrated as a common, compact component in the low-voltage switchgear assembly.

Furthermore, one preferred refinement of an embodiment of the invention provides for the bearing element to have, on its side facing the arc-quenching chamber, at least one groove-like depression which preferably passes peripherally around the inlet openings for the switching gases. These at least one, preferably two or more, depressions, which in particular also cross over one another, result in an increase in the size of the leakage paths, with the result that, even after the bearing element has been blackened, for example in the event of a short-circuit disconnection, sufficient dielectric strength remains between the poles of the switching gas damper.

In addition, an untrue gas labyrinth is created for the switching gas. This forms a flow resistance for the switching gases, with the result that the switching gases are thus reliably fed to the at least one inlet opening in a switching gas damper. The arrangement of additional splitters, possibly requiring additional physical space, or the like is thus not necessary.

BRIEF DESCRIPTION OF THE DRAWINGS

The invention will be explained in more detail below in an example embodiment with reference to the associated drawings, in which.

DETAILED DESCRIPTION OF THE EXAMPLE EMBODIMENTS

Figure 1:
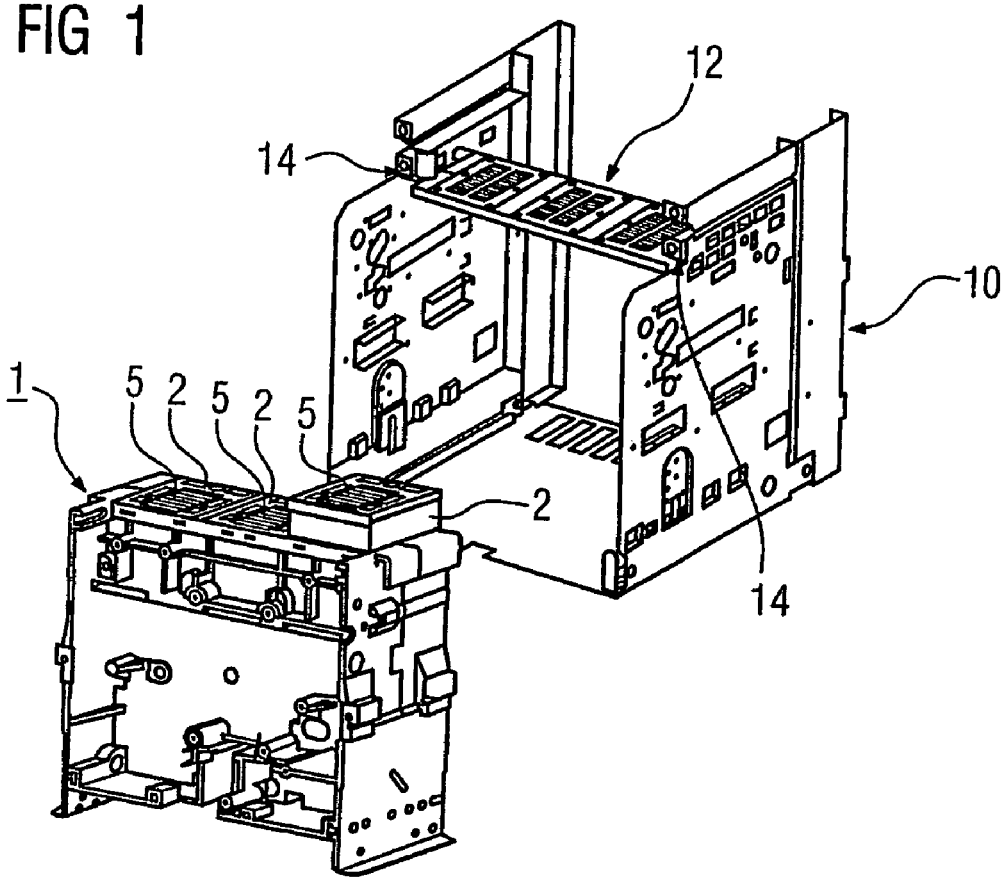
FIG. 1 shows a perspective view of an arrangement which includes a guide frame, which is provided with a switching gas damper, and a withdrawn low-voltage power circuit breaker.

FIG. 1 shows a guide frame denoted 10 and a low-voltage power circuit breaker denoted 1. By way of the guide frame 10, the low-voltage power circuit breaker 1 can be introduced into a switchgear cell (not shown) of a low-voltage switchgear cabinet or a low-voltage switchgear assembly. The low-voltage power circuit breaker itself is not completely shown, since its design and operation are generally known.

A switching gas damper which is as a whole denoted 12 is assigned to the arc-quenching chambers 2 of the low-voltage power circuit breaker 1. The switching gas damper 12 is in this case arranged above the arc-quenching chambers, to be precise immediately adjacent to the arc-quenching chambers such that outlet openings 5 of the arc-quenching chambers 2 face the switching gas damper. The switching gas damper 12 itself is connected in a force-fitting manner to side walls 3, 4 of the guide frame 10 by way of fixing elements 14, which can be formed, for example, by screw connections, latching connections or the like.

Figure 2:
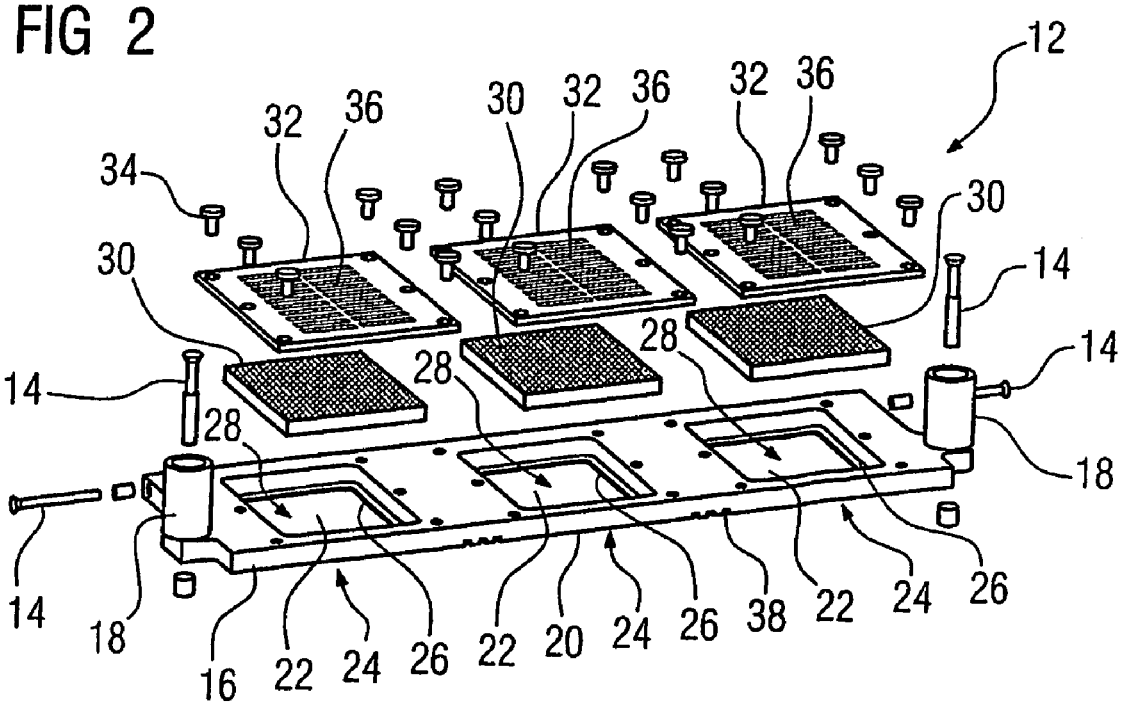
FIG. 2 shows an exploded illustration of a switching gas damper.

FIG. 2 shows an exploded illustration of the switching gas damper 12. The switching gas damper 12 includes a bearing element 16, by which the switching gas damper 12 is fixed to the guide frame 10 using the fixing elements 14. The switching gas damper 12 can be positioned by use of spacer elements 18. By selecting the size, in particular the height of the spacer elements 18, it is possible to space the switching gas damper 12, in this case in particular the underside 20 of the switching gas damper 12, from the arc-quenching chamber of the low-voltage power circuit breaker. This spacing is selected to be as small as possible and is, for example, approximately 1 mm.

The bearing element 16 is made of, for example, hardboard or a duroplast material.

The bearing element 16 has three apertures 22. The apertures 22 form inlet openings 24 for the switching gases emerging from the arc-quenching chamber on the underside 20 of the bearing element 16. The inlet openings 24 are delimited by an edge-side web 26. The web 26 is formed such that it passes peripherally around the edge of the apertures 22, in accordance with the embodiment illustrated. This results in trough-like depressions 28 being formed within the bearing element 16. At their base, the trough-like depressions 28 are thus delimited by the web 26 and the inlet openings 24.

In accordance with further embodiments, in each case one web 26 can be provided. For example, in can be provided only on opposing narrow sides or long sides. It is also possible to form the web 26 such that it is not continuous, but to form it from tooth-like projections or the like which are arranged such that they are spaced apart from one another. This makes it possible to increase the size of the effective inlet opening 24 without increasing the size of the apertures 22.

Essentially two-dimensional flow elements 30 are introduced into the trough-like depressions 28. The flow elements 30 are formed, for example, by steel wire nets. They can be formed in one layer or else in a plurality of layers. The steel wire nets may be folded in meandering fashion and introduced into the trough-like depressions 28 as a block. In place of the steel wire nets, other flow elements may also be introduced, for example perforated plates, mat elements or the like.

The height of the flow elements 30 corresponds to the height of the trough-like depressions 28. Thus, the flow elements 30 lie within the trough-like depression 28 on the webs 26 and that their surface is essentially flush with the surface of the bearing element 16.

The switching gas damper 12 also includes closure elements 32, which can be connected in a force-fitting manner to the bearing element 16 by way of fixing elements 34, for example screws. The flow elements 30 are fixed in the trough-like depressions 28 by means of the closure elements 32. The closure elements 32 have apertures 36, which may be in the form of, for example, slots (as illustrated), holes, elongate holes or the like. All of the areas of the apertures 36 of a closure element 32 thus form the outlet opening for the switching gases from the switching gas damper 12.

It becomes clear from the explanations relating to figure 2 that the switching gas damper 12 as a whole has a very compact design which, in particular, requires a low installation height. The switching gas damper 12 can thus also be integrated in low-voltage switchgear assemblies, in particular in guide racks for low-voltage power circuit breakers, which have only a limited amount of installation space available.

In accordance with the example embodiment illustrated, the switching gas damper 12 forms three flow paths for the switching gases, for example for a three-pole low-voltage power circuit breaker. In accordance with further example embodiments, the number of flow paths can vary. It is thus conceivable even to provide a flow path for a multi-pole low-voltage power circuit breaker. Correspondingly, the number of apertures 22 and flow elements 30 and closure elements 32 would be reduced.

Figure 3:
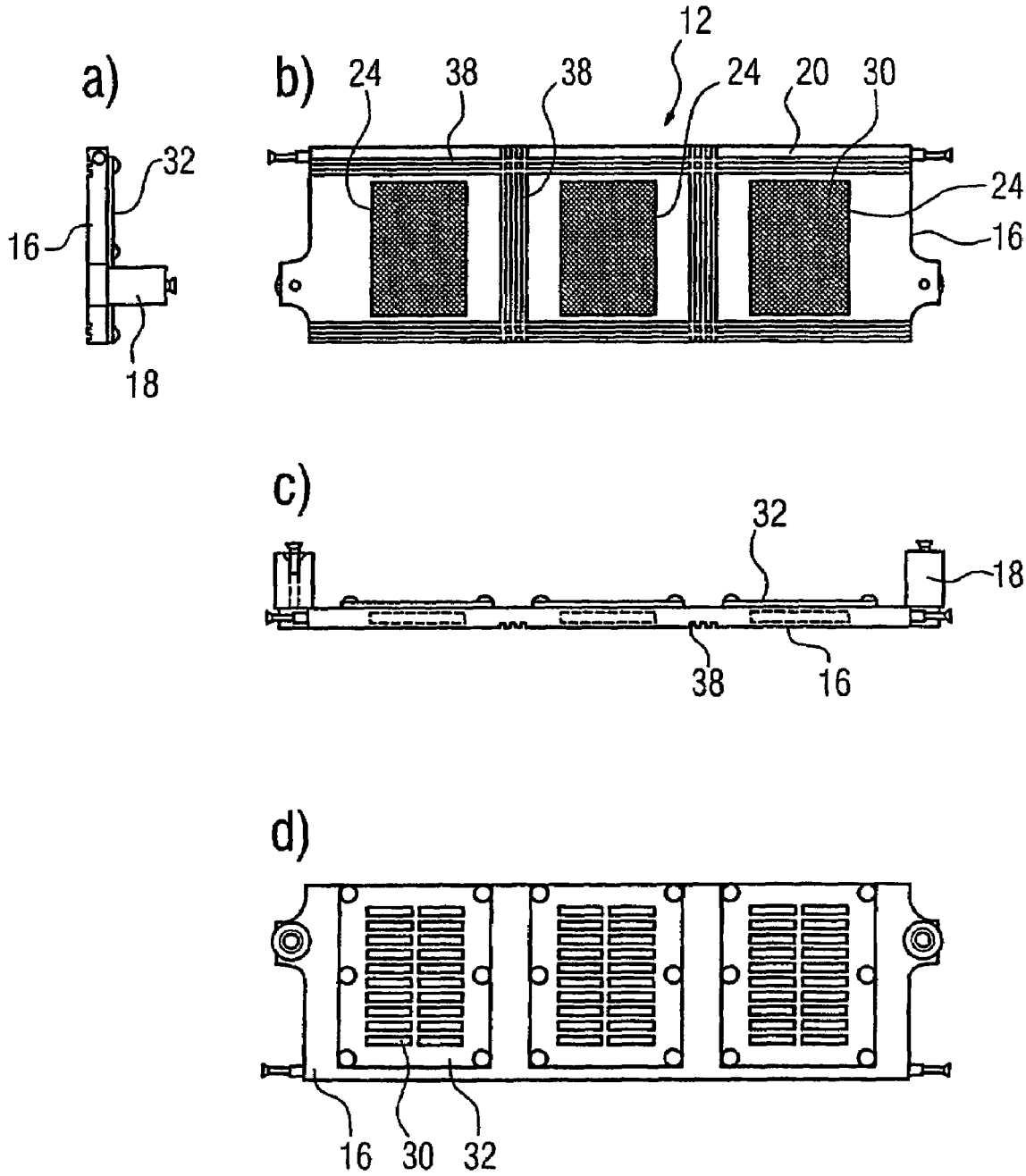
figures 3*a* to 3*d* show different views of the switching gas damper.

FIG. 3 shows once again different views of the switching gas damper 12, FIG. 3*a* showing a side view, FIG. 3*b* a view from below, FIG. 3*c* a front view, and FIG. 3*d* a plan view. Identical parts to those in the previous figures are provided with identical reference numerals and are not explained again.

The very compact, in particular flat design of the switching gas damper 12 can again be seen in this illustration.

As is shown, in particular, in the view from below in FIG. 3*b*, groove-like depressions 38 are provided on the underside 20 of the bearing element 16 and surround the inlet opening 24. In accordance with the example embodiment shown, two depressions 38, which are arranged parallel to one another, are provided in the longitudinal extent of the switching gas damper 12 and three depressions 38, which are arranged parallel to one another, are provided in the transverse extent of the switching gas damper 12.

These depressions thus cross over one another. These groove-like depressions 38 increase the size of the leakage paths, with the result that, even after the bearing element has been blackened, for example in the event of short-circuit disconnections, sufficient dielectric strength remains between the poles of the switching gas damper. In addition, an untrue gas labyrinth for the switching gases emerging from the arc-quenching chambers of the low-voltage power breaker is formed for the switching gas. The depressions 38 thus form a flow resistance for the switching gases and thus form almost guiding elements for the switching gases, with the result that said switching gases can flow into the respectively assigned inlet opening 24.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An arrangement, comprising:

a guide frame insertable into a switchgear cell:

a switching gas damper attached to the guide frame, the switching gas damper including:

a bearing element having at least one inlet opening formed in the bearing element for receiving switching gases and at least one accommodating area for a flow element disposed in the accommodating area, the flow element adapted to build up flow resistance for the switching gases, at least one closure element, that forms an outlet opening for damping or ionizing the switching gases, fixed to the bearing element over the at least one accommodating area; and a separate low voltage power circuit breaker having an arc-quenching chamber, the separate low voltage power circuit breaker insertable beneath the switching gas damper of the guide frame.

2. The arrangement as claimed in claim 1, wherein the switching gas damper is adapted to be positioned in relation to the arc-quenching chamber by selectable spacer elements.

3. The arrangement as claimed in claim 1, wherein the accommodating area for the flow element is formed by a trough-like depression in the bearing element.

4. The arrangement as claimed in claim 3, wherein a base of the trough-like depression, whilst forming an at least partially peripheral retaining web, at the same time forms the inlet opening for the switching gases into the switching gas damper.

5. The arrangement as claimed in claim 4, wherein the retaining web is formed on opposing narrow sides or long sides of the inlet openings.

6. The arrangement as claimed in claim 1, wherein the at least one flow element is formed by at least one of steel wire nets, perforated plates, and mat elements, arranged in at least one layer.

7. The arrangement as claimed in claim 1, wherein the total height of the flow elements corresponds to the total height of the bearing element.

8. The arrangement as claimed in claim 1, wherein the bearing element forms a number of accommodating areas for flow elements, which corresponds to the number of switching poles of the low-voltage power circuit breaker.

9. The arrangement as claimed in claim 1, wherein the bearing element has, on its side facing the arc-quenching chamber, at least one groove-like depression which passes peripherally around the inlet openings for the switching gases.

10. The arrangement as claimed in claim 1, wherein the bearing element is fixed to side walls of the guide frame.

11. The switching gas damper as claimed in claim 2, wherein the accommodating area for the flow element is formed by a trough-like depression in the bearing element.

12. The switching gas damper as claimed in claim 11, wherein a base of the trough-like depression, whilst forming an at least partially peripheral retaining web, at the same time forms the inlet opening for the switching gases into the switching gas damper.

13. A switching gas damper for a low-voltage power circuit breaker, the switching gas damper, comprising:

at least one inlet opening, formed by a bearing element, for switching gases; and at least one outlet opening for damped or completely ionized switching gases, wherein the switching gas damper is arrangeable above an arc-quenching chamber of the low-voltage power circuit breaker, wherein the bearing element is fixed on a guide frame separate from the low-voltage power circuit breaker for inserting the low-voltage power circuit breaker into a switchgear cell, and the bearing element forms at least one accommodating area for a flow element adapted to build up a flow resistance for the switching gases, wherein the at least one accommodating area is closable by at least one closure element adapted to fix the at least one flow element, and wherein the at least one closure element forms the at least one outlet opening.

14. The switching gas damper as claimed in claim 13, wherein the switching gas damper is adapted to be positioned in relation to the arc-quenching chamber by selectable spacer elements.

15. The switching gas damper as claimed in claim 13, wherein the accommodating area for the flow element is formed by a trough-like depression in the bearing element.

16. The switching gas damper as claimed in claim 15, wherein a base of the trough-like depression, whilst forming an at least partially peripheral retaining web, at the same time forms the inlet opening for the switching gases into the switching gas damper.

17. The switching gas damper as claimed in claim 16, wherein the retaining web is formed on opposing narrow sides or long sides of the inlet openings.

18. The switching gas damper as claimed in claim 13, wherein the at least one flow element is formed by at least one of steel wire nets, perforated plates, and mat elements, arranged in at least one layer.

19. The switching gas damper as claimed in claim 13, wherein the total height of the flow elements corresponds to the total height of the bearing element.

* * * * *